US008606121B2

(12) United States Patent
Nakata

(10) Patent No.: US 8,606,121 B2
(45) Date of Patent: Dec. 10, 2013

(54) REMOTE MANAGEMENT SYSTEM, REMOTE SETTING METHOD AND IMAGE FORMING DEVICE

(75) Inventor: Hiroshi Nakata, Itami (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 190 days.

(21) Appl. No.: 13/352,955

(22) Filed: Jan. 18, 2012

(65) Prior Publication Data

US 2012/0195603 A1 Aug. 2, 2012

(30) Foreign Application Priority Data

Feb. 1, 2011 (JP) ..... 2011-020034

(51) Int. Cl.
*G03G 15/00* (2006.01)

(52) U.S. Cl.
USPC ..... 399/8; 399/9

(58) Field of Classification Search
USPC ..... 399/1, 8, 9, 11, 18; 709/224
See application file for complete search history.

(56) References Cited

U.S. PATENT DOCUMENTS 5,414,494 A * 5/1995 Aikens et al. ..... 399/1
6,766,118 B2 * 7/2004 Moteki ..... 399/8

FOREIGN PATENT DOCUMENTS

JP 2001-175128 A 6/2001
JP 2006-091135 A 4/2006
JP 2006-123183 A 5/2006

* cited by examiner

*Primary Examiner* — Hoang Ngo
(74) *Attorney, Agent, or Firm* — Buchanan Ingersoll & Rooney PC

(57) ABSTRACT

Disclosed is a remote management system including: a first image forming device; a second image forming device which is communicable with the first image forming device by using a first communication system; and a remote management server which is communicable with the second image forming device by using a second communication system, wherein the remote management server transmits setting information for the first image forming device to the second image forming device communicable with the first image forming device by using the first communication system, by using the second communication system, the second image forming device transmits the setting information received from the remote management server, to the first image forming device by using the first communication system, and the first image forming device carries out a setting operation in accordance with the setting information received from the second image forming device.

13 Claims, 14 Drawing Sheets

FIG.5

60

| DEVICE TO WHICH SETTING INFORMATION IS TRANSMITTED | DEVICE ID | DEVICE NAME | IDENTIFIER | CONNECTING STATUS | | INSTALLATION PLACE | COMPANY | THE NUMBER OF SHEETS ON WHICH IMAGES ARE PRINTED |
|---|---|---|---|---|---|---|---|---|
| | | | | DIRECT | INDIRECT | | | |
| ○ | 11100001 | $A_0$ | 12511218 | ○ | × | TOKYO | A | 2400 |
| | 11100002 | B | 21124118 | × | × | TOKYO | A | – |
| ○ | 11100003 | $A_1$ | 12123484 | ○ | × | TOKYO | A | 29293 |
| | 11100004 | C | 81254442 | × | ○ (11100008) | NAGOYA | C | 44471 |
| | 11100008 | C | 11111368 | ○ | | NAGOYA | C | 661 |
| ○ | 222000011 | $A_2$ | 14716428 | ○ | | TOKYO | A | 2292 |
| | ····· | ·· | ···· | ·· | ··· | ·· | ·· | ·· |
| ○ | 333000121 | $A_{MAX}$ | 75463718 | ○ | ○ | TOKYO | A | 1112 |
| | 44401011 | R | 24222215 | ○ | ○ | FUKUOKA | U | 11919 |

FIG.7

608

| DEVICE TO WHICH SETTING INFORMATION IS TRANSMITTED | DEVICE ID | DEVICE NAME | IDENTIFIER | CONNECTING STATUS | | INSTALLATION PLACE | COMPANY | THE NUMBER OF SHEETS ON WHICH IMAGES ARE PRINTED |
|---|---|---|---|---|---|---|---|---|
| | | | | DIRECT | INDIRECT | | | |
| ○ | 11100001 | $A_0$ | 12511218 | ○ | × | TOKYO | A | 2400 |
| | 11100002 | B | 21124118 | × | ○ (11100001) | TOKYO | A | - |
| ○ | 11100003 | $A_1$ | 12123484 | ○ | × | TOKYO | A | 29292 |
| | 11100004 | C | 81254442 | × | ○ (11100008) | NAGOYA | C | 44471 |
| | 11100005 | C | 11111368 | ○ | | NAGOYA | C | 661 |
| ○ | 22200011 | $A_2$ | 14716428 | ○ | | TOKYO | A | 2292 |
| | ・・・・・ | ・・ | ・・・・ | ・・ | ・・・ | ・・ | ・・ | ・・ |
| ○ | 33300121 | $A_{MAX}$ | 75463718 | ○ | ○ | TOKYO | A | 1112 |
| | 44401011 | B | 24222315 | ○ | ○ | FUKUOKA | U | 11919 |

FIG.14

60C

| DEVICE TO WHICH SETTING INFORMATION IS TRANSMITTED | DEVICE ID | DEVICE NAME | IDENTIFIER | CONNECTING STATUS | | INSTALLATION PLACE | COMPANY | THE NUMBER OF SHEETS ON WHICH IMAGES ARE PRINTED |
|---|---|---|---|---|---|---|---|---|
| | | | | DIRECT | INDIRECT | | | |
| ○ | 11100001 | $A_0$ | 12511218 | ○ | × | TOKYO | A | 2400 |
| | 11100002 | B | 21124118 | ○ | ○ (11100001) | TOKYO | A | - |
| ○ | 11100003 | $A_1$ | 12123484 | ○ | × | TOKYO | A | 29292 |
| | 11100004 | C | 61254442 | × | ○ (11100006) | NAGOYA | C | 44471 |
| | 11100008 | C | 11111368 | ○ | | NAGOYA | C | 561 |
| ○ | 22200011 | $A_2$ | 14716428 | ○ | | TOKYO | A | 2292 |
| | ・・・・・ | ・・ | ・・・・ | ・・ | ・・・ | ・・ | ・・ | ・・ |
| ○ | 33300121 | $A_{MAX}$ | 75463718 | ○ | ○ | TOKYO | A | 1112 |
| | 44401011 | R | 24222215 | ○ | ○ | FUKUOKA | U | 11910 |

REMOTE MANAGEMENT SYSTEM, REMOTE SETTING METHOD AND IMAGE FORMING DEVICE

BACKGROUND OF THE INVENTION

1. Field of the Invention

The present invention relates to a remote management system and a remote setting method for remotely setting an image forming device, and an image forming device for remotely setting another image forming device.

2. Description of Related Art

In general, an image forming device, such as a printer, a multi-function peripheral or the like, which is installed in an office or the like, is remotely managed from a remote management server in a management company via a communication line in order to maintain the image forming device to be always normally used. As a remote management, the management for consumable supplies and the number of sheets used in the printing is carried out. Further, in the remote management, in order to maintain the printout having the normal image quality, for example, various parameters are changed in accordance with the usage environment.

Although the following print system is not used as the remote management, the print system for carrying out the communication setup for wirelessly connecting a printer with a personal computer for transmitting print data to the printer is known. The communication setup can be carried out by using an infrared remote controller (See Japanese Patent Application Publication No. 2006-123183).

As described above, the remote management is widely used. However, the connection setup for starting the remote management for a newly installed image forming device is still carried out by a service personnel who visits the place in which the image forming device is newly installed. Therefore, the above connection setup is inconvenient.

Further, if the above connection setup has not yet be done, the other various settings cannot be carried out by the remote management, as a matter of course.

Even in the setup carried out by using the infrared remote controller, which is disclosed in Japanese Patent Application Publication No. 2006-123183, a service personnel having the remote controller is still required to visit the place in which the image forming device is newly installed in order to carry out the setting. Therefore, it is not possible to solve the problem caused in the above remote management.

SUMMARY

To achieve at least one of the abovementioned objects, a remote management system reflecting one aspect of the present invention comprises:

a first image forming device;

a second image forming device which is communicable with the first image forming device by using a first communication system; and a remote management server which is communicable with the second image forming device by using a second communication system, wherein the remote management server transmits setting information for the first image forming device to the second image forming device communicable with the first image forming device by using the first communication system, by using the second communication system, the second image forming device transmits the setting information received from the remote management server, to the first image forming device by using the first communication system, and the first image forming device carries out a setting operation in accordance with the setting information received from the second image forming device.

Preferably, the setting information includes a connection setup for setting up a communication in which the first image forming device communicates with the remote management server not via another image forming device.

Preferably, the remote management server manages each image forming device by registering information to a registering unit, the information indicating whether one image forming device is directly communicable with the remote management server not via another image forming device, and indicating whether the one image forming device is indirectly communicable with the remote management server via another image forming device and indicating the another image forming device in case that the one image forming device is indirectly communicable with the remote management server via the another image forming device.

Preferably, when the registering unit registers the information indicating that the first image forming device is neither directly nor indirectly communicable with the remote management server, the remote management server selects an image forming device which is directly communicable with the remote management server as the second image forming device from contents registered to the registering unit, and transmits the setting information to the second image forming device, and the second image forming device replies a communication result to the remote management server, the communication result indicating whether the second image forming device has transmitted the setting information to the first image forming device.

Preferably, the registering unit registers installation place information indicating an installation place of each image forming device, and when the registering unit registers the information indicating that the first image forming device is neither directly nor indirectly communicable with the remote management server, the remote management server selects an image forming device which is installed near the first image forming device and is directly communicable with the remote management server, as the second image forming device from the contents registered to the registering unit.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein:

FIG. 5 is an explanatory view showing a management table (indicating the registered initial status of the image forming device B) held by the remote management server;

FIG. 7 is an explanatory view showing the management table (indicating the status in which the image forming device B is indirectly connected) held by the remote management server;

FIG. 14 is an explanatory view showing the management table (indicating the status in which the image forming device B is directly connected) held by the remote management server.

DETAILED DESCRIPTION OF PREFERRED EMBODIMENT

Hereinafter, a preferred embodiment of the present invention will be explained with reference to the accompanying drawings.

Figure 1:
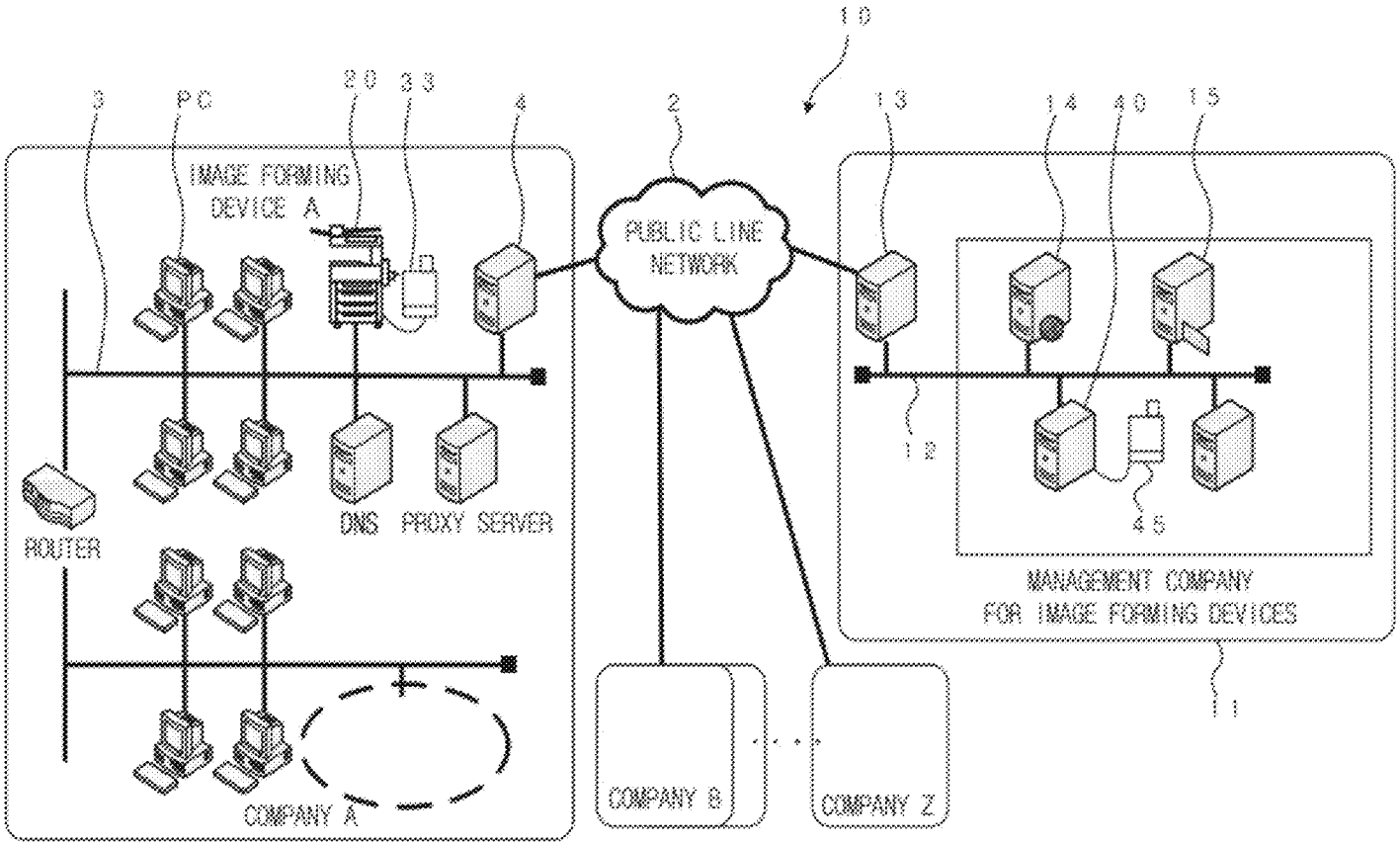
FIG. 1 is an explanatory view showing a configuration example of a remote management system according to the embodiment.

FIG. 1 shows the configuration example of a remote management system 10 according to one embodiment of the present invention. The remote management system 10 comprises a plurality of image forming devices 20 which are installed in the respective places, and a remote management server 40 for remotely managing a plurality of image forming devices 20. The remote management server 40 is installed in a management company 11 and is connected with image forming devices 20 via a public line network 2, such as the Internet, a telephone line or the like.

The image forming device 20 is a so-called multi-function peripheral having functions to execute various jobs, such as a copy job for reading an original optically to print the image obtained by reading the original on recoding paper, a scan job for storing image data of the scanned original as a file and transmitting the data to an external terminal, a PC print job for printing out the image of print data received from a terminal device, such as a personal computer, on recording paper, and the like.

The remote management server 40 remotely carries out various settings for each image forming device 20 via the public line network 2. Further, the remote management server 40 collects various types of information from each image forming device 20 to manage the maintenance, the accounting and the like of each image forming device 20.

In an example of FIG. 1, a company network 12, such as a LAN (Local Area Network), is provided in the management company 11. The company network 12 is connected with the Internet which is one of the public line networks 2, via a gateway 13. In the company network 12 of the management company 11, an HTTP server 14, a mail server 15 and the like are connected in addition to the remote management server 40. Further, a public telephone line network which is one of the public line networks 2 is connected with the remote management server 40 via a modem I/F unit 45.

The image forming devices 20 to be managed by the remote management server 40 of the management company 11 are installed in a plurality of companies, company A, company B, company C and the like. In each company, a plurality of image forming devices 20 are installed.

For example, in case of the company A, a company network 3, such as a LAN, is provided. The company network 3 is connected with the public line network 2 via a gateway 4. In this company network 3, a router, the image forming devices 20, many information processing terminals (PC), a DNS server, a proxy server and the like are connected.

Further, in this example, in the company A, the image forming device A is previously installed. In the position enclosed by a dashed ellipse shown in FIG. 1, it is planned to newly install an additional image forming device B. The image forming device A which is previously installed is connected with the remote management server 40 of the management company 11 via the public line network 2 so as to be directly communicable with each other. A communication system for directly connecting with each other may be, but not limited to, a system using a telephone line network via a modem, or a system using the Internet. Hereinafter, the communication system via which the image forming device A communicates with the remote management server 40 is referred to as a second communication system. In this embodiment, the second communication system is one for carrying out the data communication between each company in which the image forming devices are installed and the management company 11. Preferably, this system includes a wide-area communication system.

Figure 2:
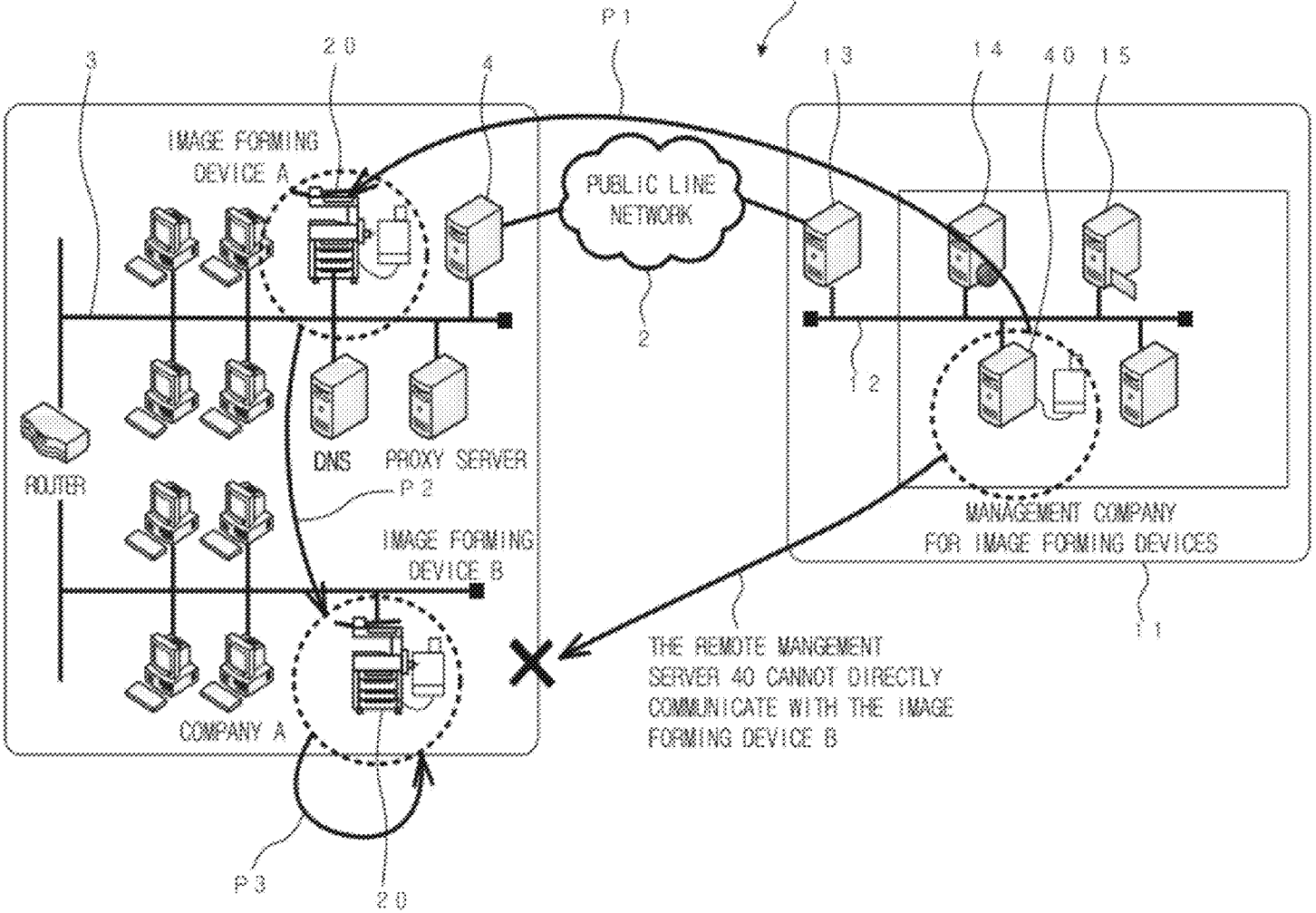
FIG. 2 is an explanatory view showing an operation procedure for the connection setup which is carried out when an image forming device is newly installed in the remote management system according to the embodiment.

FIG. 2 shows the operation procedure in case that when the image forming device B is newly installed in the company A, the setting for the image forming device B is carried out from the remote management server 40. Although the image forming device B is not connected with the remote management server 40 for direct communication, the image forming device B is connected with the image forming device A installed in the company A so as to be communicable with each other.

The communication system via which the image forming device A communicates with the image forming device B is referred to as a first communication system. As the first communication system, for example, but not limited to, the communication via the company network 3 in the company A, and a short-range wireless communication such as Bluetooth® (the communication which is compliment with IEEE 802.15) may be adopted. In this embodiment, the first communication system is one for carrying out the data communication between the image forming device A and the image forming device B which are installed in the company. Preferably, this system is a comparatively local and/or secure communication system.

When the remote management server 40 carries out the setting for the image forming device B, the remote management server 40 transmits the setting information for the image forming device B to the image forming device A which is previously communicable with the remote management server 40, by using the second communication system (P1). The image forming device A which receives the setting information for the image forming device B from the remote management server 40 transmits the received setting information to the image forming device B by using the first communication system (P2). The image forming device B which receives the setting information for the image forming device B from the image forming device A carries out the setting operation in accordance with the received setting information (P3). In the setting operation, for example, the image forming device B carries out the setting for the image forming device B or the setting for an external device such as a modem, various servers or the like if necessary.

As described above, in the remote management system 10, the image forming device B is remotely set via the image forming device A which is previously connected with the remote management server 40. Thereby, even though the image forming device B is not connected with the remote management server 40 for direct communication, if the image forming device B can communicate with another image forming device A which is communicable with the remote management server 40, it is possible to carry out the various settings for the image forming device B via the image forming device A from the remote management server 40.

Hereinafter, the configuration and the operation of the remote management system 10 will be explained in detail.

Figure 3:
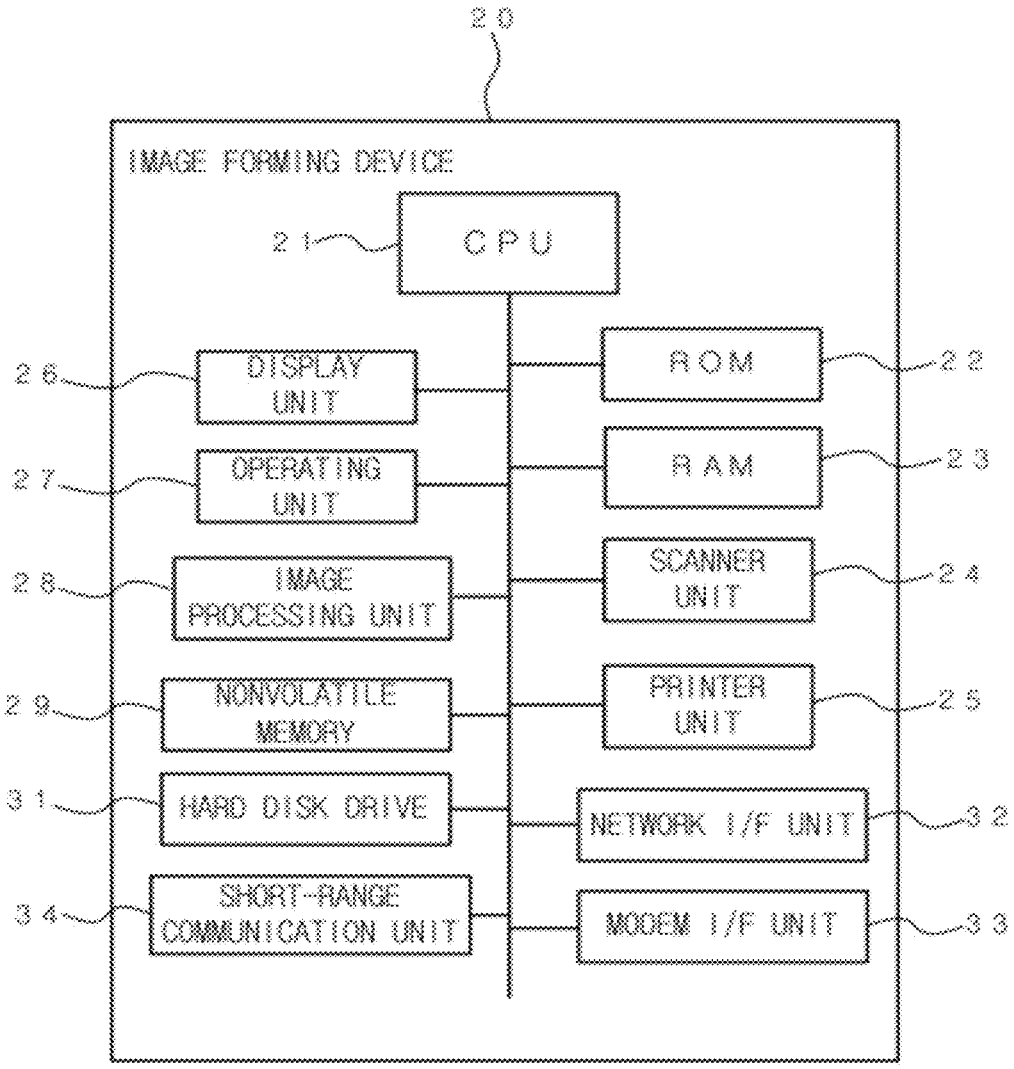
FIG. 3 is a block diagram showing a schematic configuration of an image forming device included in the remote management system according to the embodiment.

FIG. 3 shows the schematic configuration of the image forming device 20. The image forming device 20 comprises a CPU (Central Processing Unit) 21 for overall controlling the operation of the image forming device 20, a ROM (Read Only Memory) 22, a RAM (Random Access Memory) 23, a scanner unit 24, a printer unit 25, a display unit 26, an operating unit 27, an image processing unit 28, a nonvolatile memory 29, a hard disk drive 31, a network I/F unit 32, a modem I/F unit 33 and a short-range communication unit 34 which are connected with the CPU 21.

By the CPU 21, a middleware, application programs and the like are executed on an OS program as a base. In the ROM 22, various types of programs are stored. By executing the processes in accordance with these programs, the CPU 21 executes the jobs and carries out various types of operations related to the remote management. The RAM 23 is used as a work memory for temporarily storing various data when the CPU 21 executes the programs and as an image memory for storing image data.

The scanner unit 24 has a function for obtaining image data by optically reading an original. For example, the scanner unit 24 comprises a light source for irradiating the original with light, a line image sensor for reading the original line by line in the width direction of the original by receiving the reflected light from the original, a moving unit for sequentially moving the reading position line by line in the longitudinal direction of the original, an optical system having lenses, mirrors and the like for guiding the reflected light from the original to the line image sensor and focusing the reflected light on the line image sensor, a converting unit for converting an analog image signal outputted from the line image sensor into digital image data, and the like.

The printer unit 25 has a function for forming an image on recording paper in accordance with the image data and for outputting the paper on which the image is formed. In this case, the printer unit 25 is configured as the so-called laser printer for forming the image by the electrophotographic process. The laser printer comprises a conveying device for the recording paper, a photoconductive drum, a charging device, a laser unit, a developing device, a transfer device, a separation device, a cleaning device and a fixing unit. In the printer unit 25, other types, such as an inkjet type may be adopted.

An operating panel of the image forming device 20 comprises the display unit 26 and the operating unit 27. The display unit 26 is configured by a liquid crystal display (LCD) or the like, and has a function for displaying various types of operation screens, setting screens and the like. The operating unit 27 receives various operations, such as the input and setting of a job, and the like, from the user. The operating unit 27 comprises a touch panel which is provided on the screen of the display unit 26. The touch panel detects a coordinate position in which the user pushes down. Further, the operating unit 27 comprises a numerical keypad, an alphabetical keypad, a start key and the like.

The image processing unit 28 carries out the rasterization processing for converting print data into image data, compression/decompression processing of image data and the like, in addition to the processings, such as enlargement/reduction and rotation of the image.

The nonvolatile memory 29 is a memory (flash memory) in which the stored contents are not damaged even if the image forming image device 20 is turned off. The nonvolatile memory 29 is used for counting the number of used sheets and the like, and for storing various types of setting information. The hard disk drive 31 is a large-capacity nonvolatile memory device, and is used for storing, for example, job data, image data, history of the executed jobs, and the like.

The network I/F unit 32 has a function for transmitting and receiving various types of information to/from an external device via a network, such as LAN. For example, the network I/F unit 32 is used when the image forming device 20 communicates with another image forming device 20 via a company network or when the image forming device 20 communicates with an external device or the remote management server 40 via the gateway 4 and the public line network 2. The modem I/F unit 33 has a function for transmitting and receiving data to/from the remote management server 40 or an external facsimile device via a public telephone line network which is one of the public line networks 2. The short-range communication unit 34 has a function for carrying out the short-range wireless communication with another equipment by using infrared ray, radio waves or the like. In the present embodiment, the Bluetooth® is used. The modem I/F unit 33 and the short-range communication unit 34 are optional. There are image forming devices 20 having the modem I/F unit 33 and/or the short-range communication unit 34, and image forming devices 20 which have neither of the above units.

Next, the configuration of the remote management server 40 will be explained.

Figure 4:
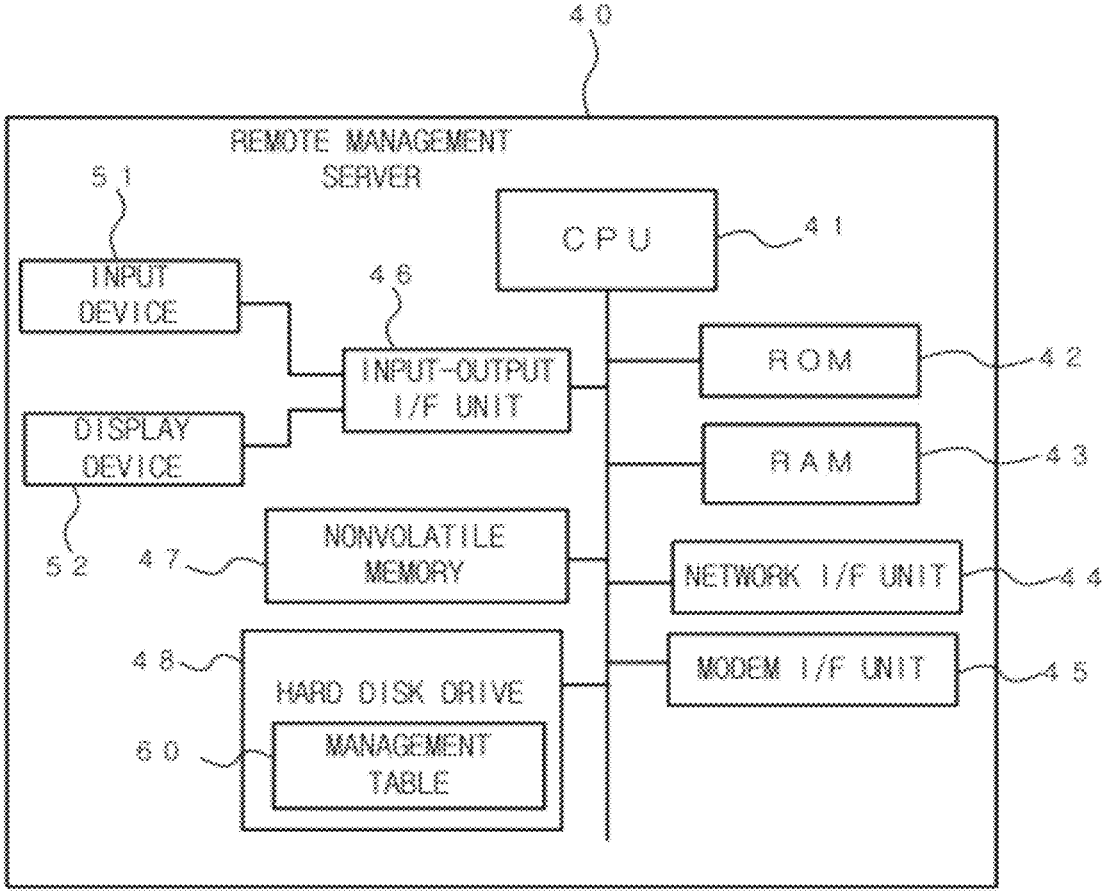
FIG. 4 is a block diagram showing a schematic configuration of a remote management server included in the remote management system according to the embodiment.

FIG. 4 shows a schematic configuration of the remote management server 40. The remote management server 40 comprises a CPU 41, a ROM 42, a RAM 43, a network I/F unit 44, a modem I/F 45, an input-output I/F unit 46, a nonvolatile memory 47 and a hard disk drive 48. The CPU 41 and the like are connected with an input device 51, such as a keyboard, a mouse and the like, and a display device 52, such as a liquid crystal display, via the input-output I/F unit 46.

In the ROM 42, a start-up program, fixed data and the like are stored. In the RAM 43, the programs loaded from the hard disk drive 48 are stored. Further, the RAM 43 is used as a work memory for temporarily storing various data when the CPU 41 executes the programs.

The network I/F unit 44 has a function for transmitting and receiving various types of information to/from an external device via a network, such as LAN. For example, the network I/F unit 44 has a function for communicating with each image forming device 20 from the company network 12 via the gateway 13 and the public line network 2. The modem I/F unit 45 has a function for transmitting and receiving data to/from each image forming device 20 via a public telephone line network which is one of the public line networks 2.

The nonvolatile memory 47 is a memory (flash memory) in which the stored contents are not damaged even if the remote management server 40 is turned off. In the nonvolatile memory 47, various types of setting information are stored. In the hard disk drive 48, a management table 60 which will be described later, a database for registering information informed from each image forming device 20 and the like are stored.

FIG. 5 shows an example of the management table 60 stored in the remote management server 40. In the management table 60, the information indicating whether the image forming device 20 is one to which the setting information is transmitted, a device ID and a device name of the image forming device 20, an identifier for uniquely identifying the image forming device 20 in the communication, a connecting status indicating the connection between the image forming device 20 and the remote management server 40, an installation place of the image forming device 20, a company in which the image forming device 20 is installed, the number of sheets on which images are printed by the image forming device 20 are registered with respect to each image forming device 20 to be managed.

The identifier registered in the management table 60 is information for uniquely identifying the image forming device 20 in the communication. A physical address or the like which is uniquely assigned to a hardware of a communication equipment is used. For example, in case that the image forming device 20 is connected by the Ethernet®, the MAC (Media Access Control) address which is uniquely assigned to the LAN card of the image forming device 20 is used as the identifier. In the communication equipment compliant with the Bluetooth®, the Bluetooth-Address (BD-ADDR) is used. The identifier is address information in case of the communication between the image forming devices 20.

In the column of the connecting status in the management table 60, there are a "direct" column and an "indirect" column. The "direct" column indicates whether the image forming device 20 indicated by the device ID is directly communicable with the remote management server 40 not via another image forming device 20. In the table, "O" indicates that the image forming device 20 is directly communicable with the remote management server 40, and "X" indicates that the image forming device 20 cannot directly communicate with the remote management server 40 (the status in which it is not confirmed that the image forming device 20 is directly communicable with the remote management server 40). The "indirect" column indicates whether the image forming device 20 indicated by the device ID is indirectly communicable with the remote management server 40 via another image forming device 20. In the table, "O" indicates that the image forming device 20 is indirectly communicable with the remote management server 40. The number shown in parentheses indicates the device ID of the image forming device (relaying the communication) via which the image forming device 20 indirectly communicates with the remote management server 40. Further, "X" indicates that the image forming device 20 cannot indirectly communicate with the remote management server 40 (the status in which it is not confirmed that the image forming device 20 is indirectly communicable with the remote management server 40).

In the management table 60 shown in FIG. 5, an initial status of the image forming device B (device name: B) which is newly installed in the company A of FIG. 1 is registered. With respect to the connecting status of the image forming device B, in both of the "direct" column and the "indirect" column, "X" are entered. The management table 60 indicates that the image forming device B can neither directly nor indirectly communicate with the remote management server 40.

Next, the process for indirectly setting the setting information for the image forming device which can neither directly nor indirectly communicate with the remote management server 40, via another image forming device, is explained. Here, the case in which the setting information for the image forming device B which is newly installed in the company A of FIG. 2 is indirectly transmitted to the image forming device B via another image forming device, is explained.

Figure 6:
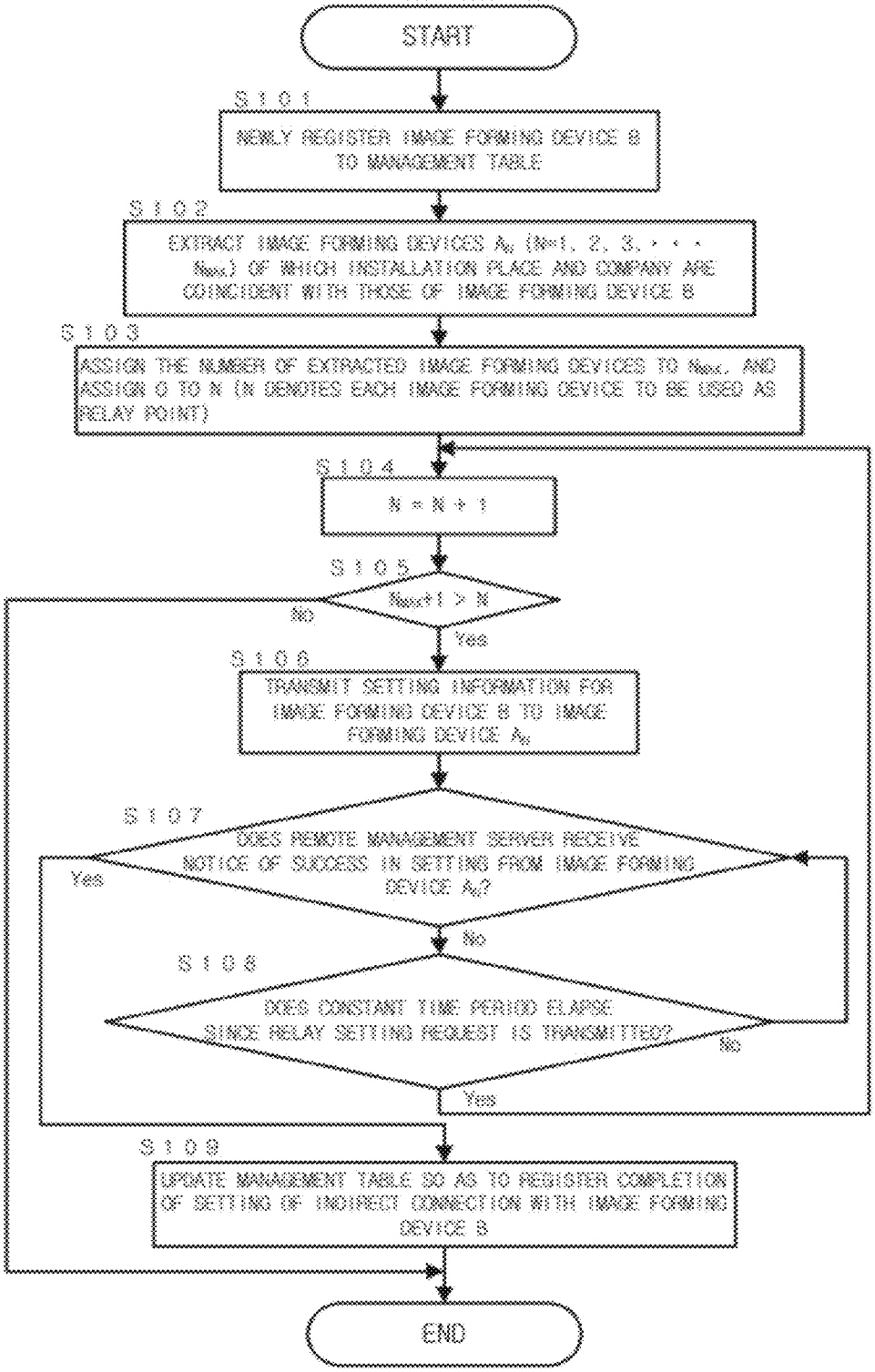
FIG. 6 is a flowchart showing the operation of the remote management server, which is carried out when the setting information is indirectly set to the image forming device B.

FIG. 6 shows the operation of the remote management server 40 in case that the setting information for the image forming device B that is newly installed in the company A is indirectly transmitted to the image forming device B via another image forming device. The setting information for the image forming device B may be setting information for enabling the image forming device B to directly communicate with the remote management server 40, or another setting information, for example, setting for parameters relating to various functions and the image quality or setting for the initial values of various counters. The kind of the above setting information is optional.

The remote management server 40 accepts the registering operation for various types of information relating to the image forming device B which is newly installed, and registers the contents thereof to the management table 60 (Step S101). This registering operation is carried out by a service personnel or the like who installs the image forming device B. In this case, as shown in the management table 60 of FIG. 5, the information, such as the device ID, the identifier and the installation place of the image forming device B and the company in which the image forming device B is installed, is registered. With respect to the connecting status, "X" (not communicable) is registered in both of the "direct" column and the "indirect" column as initial values.

Next, the CPU 41 of the remote management server 40 extracts the image forming devices which are estimated to be installed near the image forming device B which is a setting destination to be set in according with the setting information, by reference to the management table 60. In this case, the CPU 41 extracts the image forming devices $A_N$ (N=1, 2, 3, . . . , Nmax) of which the installation place is coincident with that of the image forming device B, and which are installed in the same company as the image forming device B (Step S102). Then, the CPU 41 selects one image forming device among the extracted image forming devices $A_N$ in order, and carries out the operation for setting the image forming device B via the selected image forming device $A_N$. This operation is carried out until the CPU 41 succeeds in setting the image forming device B or until the CPU 41 has attempted to use all of the extracted image forming devices $A_N$ as a relay point.

In detail, the CPU 41 assigns the number of all of the extracted image forming devices $A_N$ to the value Nmax and the initial value 0 to the value N (Step S103). Then, the CPU 41 adds +1 to the value N (Step S104). If Nmax+1 is not more than N (Nmax+1≤N) (Step S105; No), the CPU 41 judges that the setting error is caused and ends the process (End). If Nmax+1 is more than N (Nmax+1>N) (Step S105; Yes), the CPU 41 transmits the setting information for the image forming device B to the image forming device $A_N$ (Step S106). In this case, the CPU 41 transmits the relay setting request including the contents of the setting information for the image forming device B and the identifier of the image forming device B, to the image forming device $A_N$.

When the CPU 41 of the remote management server 40 does not receive the notice of the success in the above setting from the image forming device $A_N$ even though the constant time period elapses since the relay setting request is transmitted (including the case in which the CPU 41 receives the notice of the failure in the above setting or the notice informing that the image forming device B is not found, before the constant time period elapses) (Step S107; No and Step S108; Yes), the process returns to the Step S104. The CPU 41 adds +1 to N and carries out the relay setting request for the next image forming device $A_N$.

In case that the remote management server 40 receives the notice of the success in the above setting from the image forming device $A_N$ before the constant time period elapses since the relay setting request is transmitted (Step S107; Yes), the CPU 41 registers the information that the remote management server 40 can indirectly connected with the image forming device B via the image forming device $A_N$, to the management table 60 (Step S109). Then, the process is ended. Specifically, the CPU 41 registers "O" to the "indirect" column of the connecting status for the image forming device B in the management table 60 and registers the device ID of the image forming device $A_N$ (relaying the communication) via which the image forming device B indirectly communicates with the remote management server 40, by enclosing it in parentheses.

FIG. 7 shows an example of the management table 60B obtained by registering the information indicating the connecting status to the management table 60 shown in FIG. 5 after it is confirmed that the image forming device B is indirectly communicable with the remote management server 40. In this example, the information indicating that the image forming device B is indirectly communicable with the remote management server 40 via the image forming device $A_0$ having the device ID of (11100001), is registered.

Figure 8:
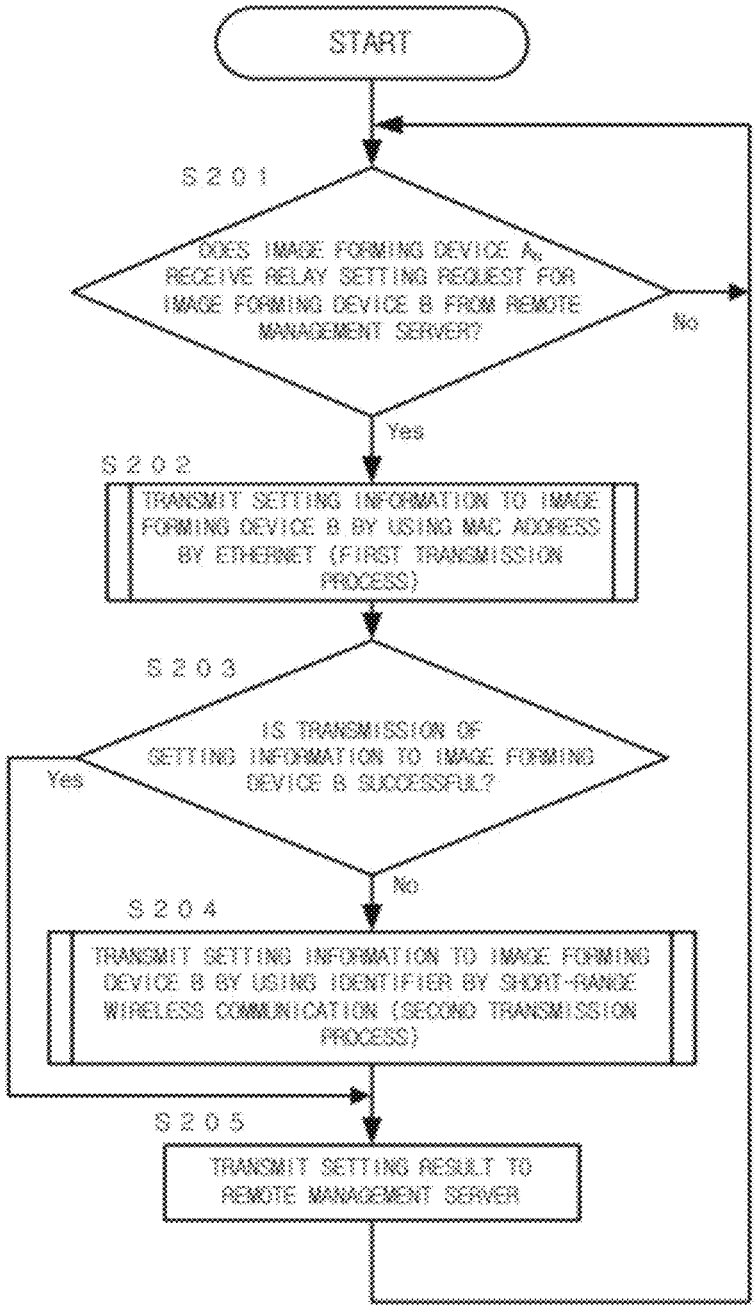
FIG. 8 is a flowchart showing the operation of the image forming device which receives an indirect setting request from the remote management server.

FIG. 8 shows a flowchart of the operation carried out by the image forming device $A_N$ when the image forming device $A_N$ receives the relay setting request for the image forming device B from the remote management server 40. The image forming device $A_N$ waits the relay setting request of the setting information for the image forming device B, which is transmitted from the remote management server 40 (Step S201; No). When the image forming device $A_N$ receives the relay setting request (Step S201; Yes), the image forming device $A_N$ attempts to transmit the setting information to the image forming device B by using the communication method corresponding to the identifier included in the relay setting request.

In case that the identifier included in the received relay setting request relates to only one communication system, the image forming device $A_N$ attempts to transmit the setting information to the image forming device B by using the above one communication system. In case that the identifiers relating to a plurality of communication systems are included in the received relay setting request, the image forming device $A_N$ attempts to transmit the setting information by using each of the above communication systems in the predetermined priority order. Here, an example of the operation which is carried out in case that two identifiers relating to the MAC address and the BD-ADDR are included in the relay setting request, is shown.

The image forming device $A_N$ carries out the first transmission process in which the MAC address included in the relay setting request is set to the destination and the setting information is transmitted by the Ethernet (Step S202). In case that the setting information can be transmitted to the image forming device B in the first transmission process (in case of the success in the setting) (Step S203; Yes), the image forming device $A_N$ transmits the setting result to the remote management server 40 (Step S205). Then, the operation returns to the Step S201.

In case that the setting information cannot be transmitted to the image forming device B in the first transmission process using the MAC address (in case that the image forming device B cannot be found or in case of the failure in the setting) (Step S203; No), the image forming device $A_N$ carries out the second transmission process in which the BD-ADDR included in the relay setting request is set to the destination address and the setting information is transmitted by using the Bluetooth communication (Step S204). The image forming device $A_N$ transmits the setting result to the remote management server 40 (Step S205). Then, the operation returns to the Step S201.

Figure 9:
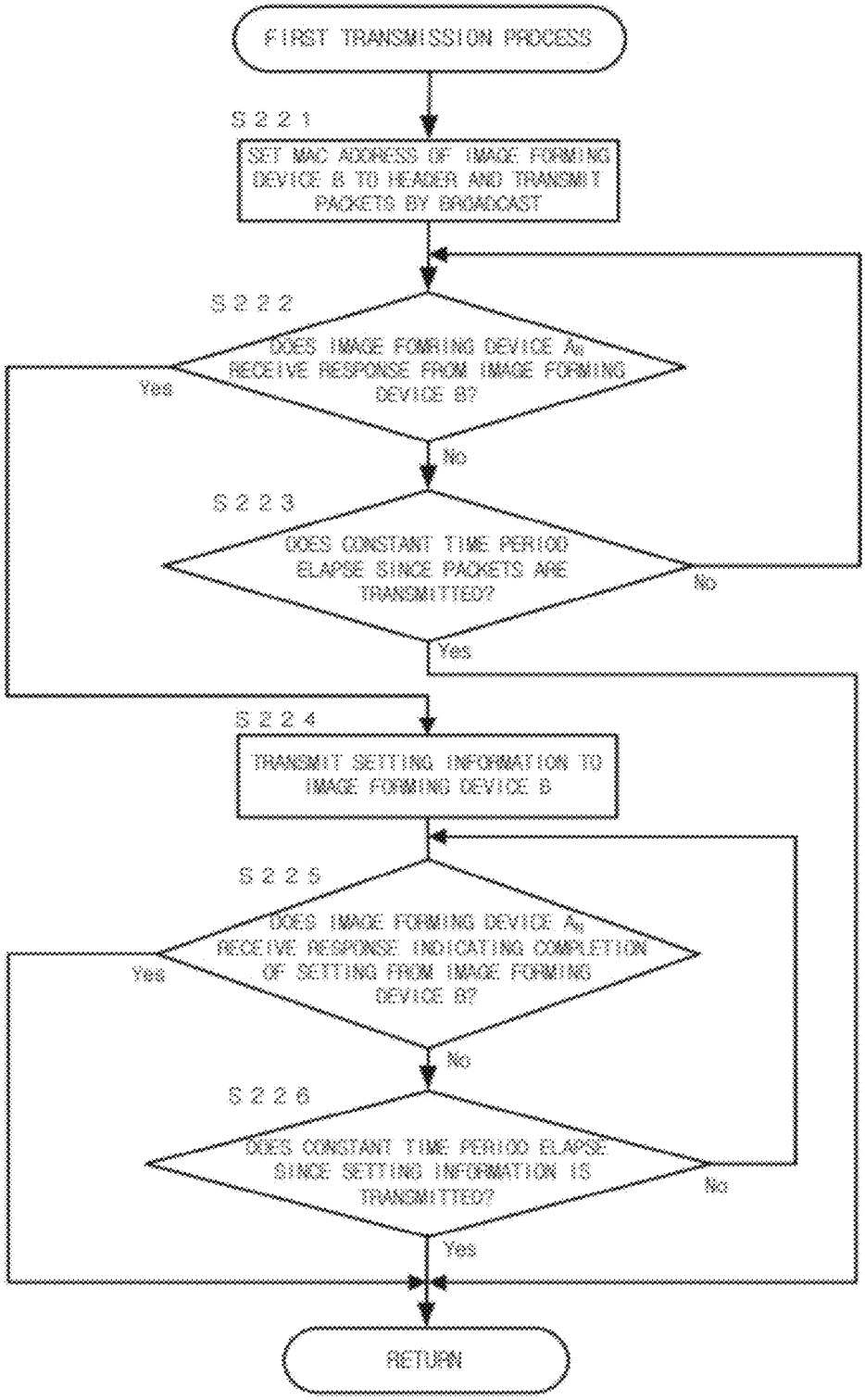
FIG. 9 is a flowchart showing a first transmission process carried out by the image forming device which receives the indirect setting request from the remote management server.

FIG. 9 shows the detail of the first transmission process carried out by the image forming device $A_N$. In the first transmission process, the image forming device $A_N$ transmits the packets in which the MAC address included in the received relay setting request is set to the header, to the company network 12 by the broadcast (Step S221). In case that the image forming device $A_N$ does not receive the response from the image forming device B even though the constant time period elapses since the above broadcast (Step S222; No and Step S223; Yes), the image forming device $A_N$ judges that the image forming device B cannot be found, and ends the process (End).

In case that the image forming device $A_N$ receives the response from the image forming device B before the constant time period elapses since the broadcast (Step S222; Yes), the image forming device $A_N$ transmits the setting information to the image forming device B via the company network 12 (Step S224). In case that the image forming device $A_N$ does not receive the response indicating the completion of the setting from the image forming device B even though the constant time period elapses since the setting information is transmitted (including the case in which the image forming device $A_N$ receives the response indicating the failure in the above setting before the constant time period elapses) (Step S225; No and Step S226; Yes), the image forming device $A_N$ judges that the setting is failed, and ends the process (Return).

In case that the image forming device $A_N$ receives the response indicating the completion of the setting from the image forming device B before the constant time period elapses since the setting information is transmitted (Step S225; Yes), the image forming device $A_N$ judges that the setting is successful, and ends the process (Return).

Figure 10:
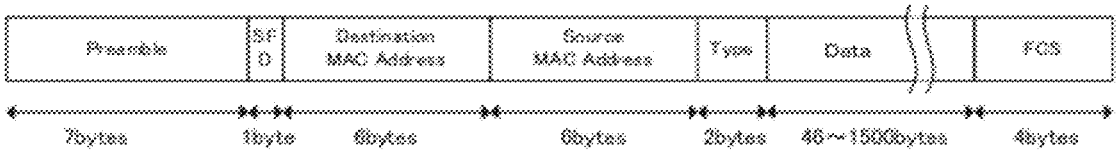
FIG. 10 is an explanatory view showing the packet structure.

FIG. 10 shows the packet structure of the Ethernet. When the broadcast is carried out, the packets in which the MAC address of the image forming device B is set to the "Destination MAC Address" field and the "Data" field is vacant, are transmitted. When the setting information is transmitted, the packets in which the MAC address of the image forming device B is set to the "Destination MAC Address" field and the setting information is set to the "Data" field, are transmitted.

Figure 11:
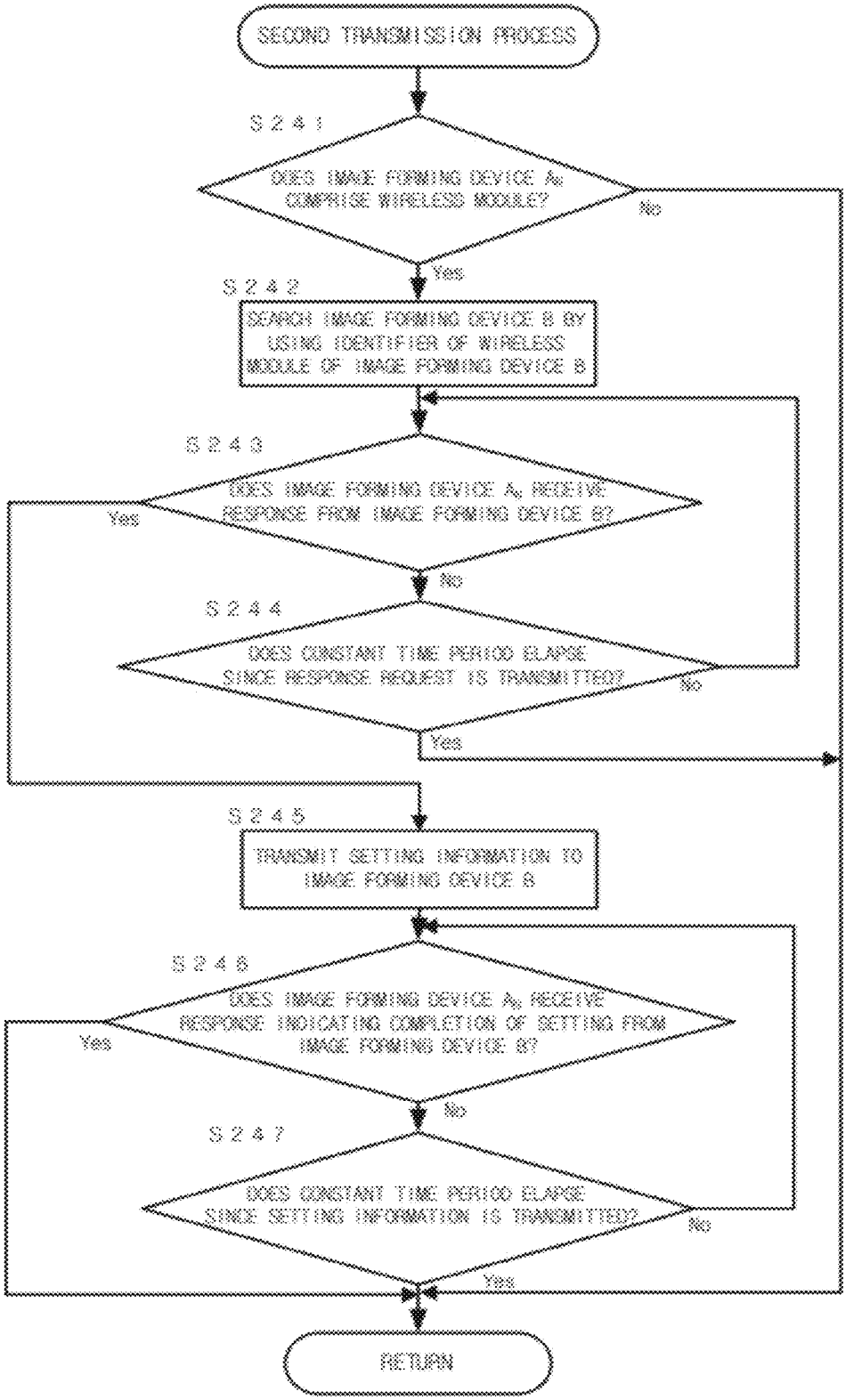
FIG. 11 is a flowchart showing a second transmission process carried out by the image forming device which receives the indirect setting request from the remote management server.

FIG. 11 shows the detail of the second transmission process carried out by the image forming device $A_N$. In the second transmission process, the image forming device $A_N$ judges whether the image forming device $A_N$ comprises the short-range communication unit 34 (in this case, a communication module for the Bluetooth) (Step S241). When the image forming device $A_N$ does not comprise the short-range communication unit 34 (Step S241; No), the image forming device $A_N$ judges that the setting is failed and ends the process (Return).

When the image forming device $A_N$ comprises the short-range communication unit 34 (Step S241; Yes), the image forming device $A_N$ searches the image forming device B by using the BD-ADDR included in the relay setting request received from the remote management server 40 (Step S242). For example, the response request is transmitted by using the BD-ADDR included in the relay setting request as the destination address.

In case that the image forming device B cannot be found, that is, in case that the image forming device $A_N$ does not receive the response from the image forming device B even though the constant time period elapses since the response request is transmitted (Step S243; No and Step S244; Yes), the image forming device $A_N$ judges that the image forming device B cannot be found, and ends the process (Return).

In case that the image forming device B is found, that is, in case that the image forming device $A_N$ receives the response from the image forming device B (Step S243; Yes), the image forming device $A_N$ transmits the setting information for the image forming device B by using the short-range communication unit 34 (Step S245). In case that the image forming device $A_N$ does not receive the response indicating the completion of the setting from the image forming device B even though the constant time period elapses since the setting information is transmitted (including the case in which the image forming device $A_N$ receives the response indicating the failure in the above setting before the constant time period elapses) (Step S246; No and Step S247; Yes), the image forming device $A_N$ judges that the setting is failed, and ends the process (Return).

In case that the image forming device $A_N$ receives the response indicating the completion of the setting from the image forming device B before the constant time period elapses since the setting information is transmitted (Step S246; Yes), the image forming device $A_N$ judges that the setting is successful, and ends the process (Return).

Figure 12:
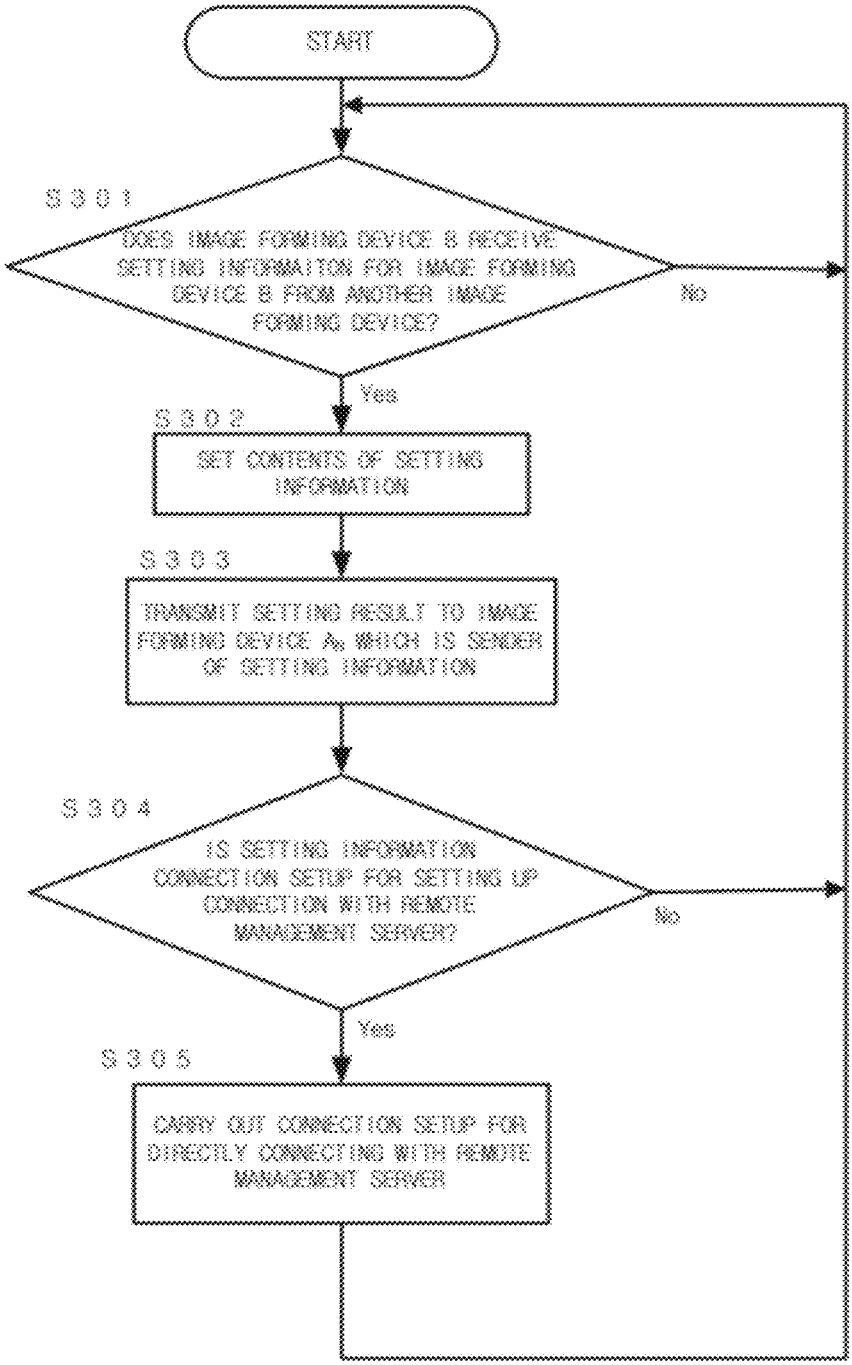
FIG. 12 is a flowchart showing the operation of the image forming device which receives the setting information for the image forming device itself from another image forming device.

FIG. 12 shows the operation of the image forming device B which is the setting destination to be set in accordance with the setting information. In case that the image forming device B receives the setting information for the image forming device B from another image forming device (Step S301; Yes), the image forming device B carries out the setting operation in accordance with the contents of the received setting information (Step S302). In the setting operation, the image forming device B carries out the setting for itself and carries out the setting for an external equipment in case of necessity.

Next, the image forming device B transmits the setting result to the image forming device $A_N$ which is the sender of the setting information (Step S303). The image forming device B determines whether the received setting information is the connection setup for setting up the connection in which the image forming device B directly communicates with the remote management server 40 (Step S304). When the setting information is not the connection setup (Step S304; No), the operation returns to Step S301. When the setting information is the connection setup (Step S304; Yes), the image forming device B carries out the connection setup for connecting with the remote management server 40 by using the second communication system for directly connecting with the remote management server 40 (Step S305). Then, the operation returns to Step S301.

Figure 13:
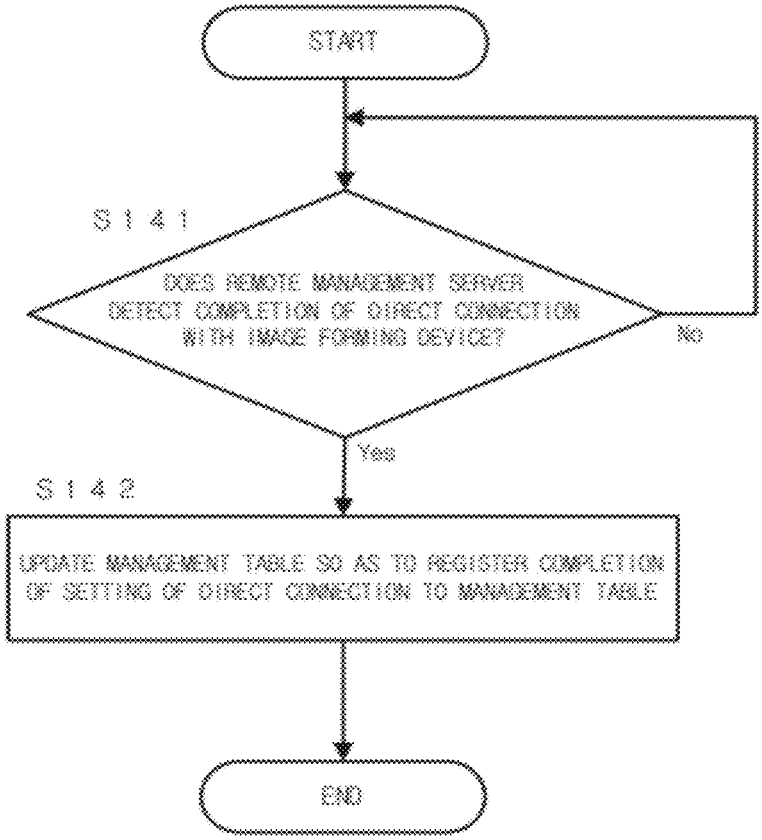
FIG. 13 is a flowchart showing the operation of the remote management server which confirms that the remote management server directly connects with the image forming device.

FIG. 13 shows the operation of the remote management server 40 in case that the image forming device B directly connects with the remote management server 40. When the remote management server 40 confirms (detects) the success in the direct connection with the image forming device B (the connection using the second communication system) (Step S141; Yes), the remote management server 40 registers the information indicating that the image forming device B is directly communicable with the remote management server 40, to the management table 60 (Step S142).

FIG. 14 shows the registering status of the management table 60C after the image forming device B is directly communicable with the remote management server 40. In the "direct" column of the connecting status for the image forming device B, "O" is registered.

As described above, in the remote management system 10, the setting for the image forming device B which does not connect with the remote management server 40 so as to be directly communicable with the remote management server 40 is indirectly carried out via another image forming device A which is directly communicable with the remote management server 40 by using the second communication system and which is communicable with the image forming device B by using the first communication system. Therefore, it is possible to carry out the setting for the image forming device B from the remote management server 40 even though the remote management server 40 is not connected with the image forming device B so as to directly communicate with the image forming device B (not via another image forming device).

In particular, when the setting (connection setup) for directly connecting with the remote management server 40 is carried out by using the indirect communication via the image forming device A, it is possible to remotely carry out the connection setup for setting up the direct connection between the remote management server 40 and the image forming device B from the remote management server 40. Thereby, it is possible to decrease the number of steps of the operation to be carried out by a service personnel or the like who visits the installation place of the image forming device B, and to reduce the work burden relating to the setting for newly installing an image forming device 20.

Further, by copying and using the connection setup information for the image forming device A within a reusable range, it is possible to reduce the operation for designating the contents of the setting information to be transmitted from the remote management server 40 to the image forming device B when the connection setup is carried out. For example, when the connection setup for communicating with the remote management server 40 is carried out via the gateway 4 by using the Internet, it is possible to reduce the work burden by copying the setting contents which are already set to the image forming device A and by reusing the setting contents within the applicable range for the image forming device B.

The remote management server 40 manages each image forming device 20 by registering the information indicating whether the remote management server 40 is directly communicable with each image forming device 20 and whether the remote management server 40 is indirectly communicable with each image forming device 20, to the management table 60. Therefore, it is possible to carry out the setting for each image forming device 20 by suitably selecting an available communication system. Further, the information (in the embodiment, the device ID) identifying the image forming device 20 relaying the communication is registered to the "indirect" column. Therefore, when the indirect communication is carried out, it is possible to correctly identify the image forming device 20 relaying the communication and to transmit the relay setting request to the identified image forming device 20.

The image forming devices $A_N$ which relay the indirect communication between the remote management server 40 and the image forming device B which can neither directly nor indirectly communicate with the remote management server 40, are narrowed down among the image forming devices registered to the management table 60 in accordance with the conditions, for example, in which the image forming device $A_N$ can directly communicate with the remote management server 40 and in which the installation place of the image forming device $A_N$ is coincident with that of the image forming device B and the image forming device $A_N$ is installed in the same company as the image forming device B. Thereby, it is possible to effectively find the image forming device $A_N$ which is indirectly communicable with the image forming device B.

As described above, the embodiment is explained by using the drawings. However, in the present invention, the concrete configuration is not limited to the above embodiment. In the present invention, various modifications of the above embodiment or the addition of various functions or the like to the embodiment can be carried out without departing from the gist of the invention.

The above embodiment is explained by exemplifying the multi function peripheral as the image forming device 20. However, the image forming device 20 may be another device, such as a copy machine, a printer or the like.

The setting for the image forming device 20 which is neither directly nor indirectly connected with the remote management server 40 may be carried out via the image forming device 20 which is indirectly connected with the remote management server 40.

The communication system for directly connecting between the remote management server 40 and the image forming device 20 is not limited to the Internet and a public telephone line. Any communication system may be used as long as the communication system can connect between the remote management server 40 and the image forming device 20. Further, the first communication system for connecting between the image forming devices 20 is not limited to the LAN and the short-range wireless communication which are exemplified in the embodiment.

In this embodiment, the image forming device 20 which is a final setting destination to be set in accordance with the setting information, is identified by the MAC address or the BD-ADDR. However, the information (identifier) for identifying the image forming device is not limited to them. As long as the information can uniquely identify the image forming device 20 to be set in the remote management system 10, any information may be used. For example, in case that the identification information (device ID) which can uniquely identify the image forming device 20 is assigned to each image forming device 20 before shipping, the above identification information may be used as an identifier.

One of the objects of the above embodiment is to provide a remote management system, a remote setting method and an image forming device in which the setting for an image forming device which is not directly connected with the remote management server can be carried out from the remote management server.

In the above embodiment, the setting information for the first image forming device is transmitted to the first image forming device from the remote management server via the second image forming device to set the first image forming device. Thereby, even though the first image forming device is not connected with the remote management server so as to be directly communicable with the remote management server not via another image forming device, it is possible to remotely carry out the setting for the first image forming device from the remote management server via the second image forming device which is communicable with the remote management server and the first image forming device.

In the above embodiment, the connection setup for setting up the communication in which the first image forming device communicates with the remote management server not via another image forming device is carried out for the first image forming device by using the indirect communication via the second image forming device. Thereby, for example, it is possible to decrease the number of steps of the operation to be carried out by a service personnel or the like who visits the installation place of the newly installed first image forming device to connect the first image forming device with the remote management server.

In the above embodiment, the remote management server can suitably select an available communication system by referring the contents registered to the registering unit, and carry out the setting for each image forming device.

In the above embodiment, even though the image forming device via which the first image forming device is communicable with the remote management server is unknown, it is possible to recognize the second image forming device which is communicable with the first image forming device, at the remote management server side by using the communication result transmitted from the second image forming device. That is, it is possible to find the second image forming device which is a relay point suitable for the indirect communication with the first image forming device. After the second image forming device is found, the remote management server can carry out the indirect communication with the first image forming device by selecting the found image forming device as a relay point.

In the above embodiment, the image forming devices which are candidates for the relay point can be narrowed down from the information relating to the installation place or the like. Thereby, when the remote management server is indirectly connected with the first image forming device to communicate with the first image forming device, it is promptly possible to identify the image forming device which relays the communication.

In the above embodiment, when the image forming device receives the setting information for another image forming device from the remote management server, the image forming device transmits the setting information to the another image forming device. Thereby, even though the another image forming device is not connected with the remote management server so as to directly communicate with the remote management server, it is possible to remotely set the another image forming device from the remote management server via the image forming device.

In the above embodiment, it is possible to carry out the connection setup for setting up the connection between the another image forming device and the remote management server so as to directly communicate with each other, by using the indirect communication via the image forming device.

In the above embodiment, the remote management server can confirm whether the another image forming device can be set via the image forming device.

According to the remote management system, the remote setting method and the image forming device disclosed in the above embodiment, the setting for another image forming device is carried out via the image forming device which is previously connected with the remote management server. Thereby, it is possible to carry out various settings for an image forming device which is not directly connected with the remote management server, from the remote management server. In particular, in case of the connection setup for setting up the direct communication in which the image forming device is communicable with the remote management server not via another image forming device, it is possible to reduce the work burden relating to the connection setup in the installation place, when an image forming device is newly installed.

What is claimed is:

1. A remote management system comprising:

a first image forming device;

a second image forming device which is communicable with the first image forming device by using a first communication system; and a remote management server which is communicable with the second image forming device by using a second communication system, wherein the remote management server transmits setting information for the first image forming device to the second image forming device communicable with the first image forming device by using the first communication system, by using the second communication system, the second image forming device transmits the setting information received from the remote management server, to the first image forming device by using the first communication system, and the first image forming device carries out a setting operation in accordance with the setting information received from the second image forming device.

2. The remote management system of claim 1, wherein the setting information includes a connection setup for setting up a communication in which the first image forming device communicates with the remote management server not via another image forming device.

3. The remote management system of claim 1, wherein the remote management server manages each image forming device by registering information to a registering unit, the information indicating whether one image forming device is directly communicable with the remote management server not via another image forming device, and indicating whether the one image forming device is indirectly communicable with the remote management server via another image forming device and indicating the another image forming device in case that the one image forming device is indirectly communicable with the remote management server via the another image forming device.

4. The remote management system of claim 3, wherein when the registering unit registers the information indicating that the first image forming device is neither directly nor indirectly communicable with the remote management server, the remote management server selects an image forming device which is directly communicable with the remote management server as the second image forming device from contents registered to the registering unit, and transmits the setting information to the second image forming device, and the second image forming device replies a communication result to the remote management server, the communication result indicating whether the second image forming device has transmitted the setting information to the first image forming device.

5. The remote management system of claim 4, wherein the registering unit registers installation place information indicating an installation place of each image forming device, and when the registering unit registers the information indicating that the first image forming device is neither directly nor indirectly communicable with the remote management server, the remote management server selects an image forming device which is installed near the first image forming device and is directly communicable with the remote management server, as the second image forming device from the contents registered to the registering unit.

6. A remote setting method, comprising:

transmitting setting information for a first image forming device to a second image forming device by using a second communication system by a remote management server for remotely management each image forming device, the second image forming device being communicable with the first image forming device by using a first communication system;

relaying the setting information received from the remote management server, to the first image forming device by using the first communication system by the second image forming device; and carrying out a setting operation for the first image forming device by the first image forming device in accordance with the setting information received from the second image forming device.

7. The remote setting method of claim 6, wherein the setting information includes a connection setup for setting up a communication in which the first image forming device communicates with the remote management server not via another image forming device.

8. The remote setting method of claim 6, wherein the remote management server manages each image forming device by registering information to a registering unit, the information indicating whether one image forming device is directly communicable with the remote management server not via another image forming device, and indicating whether the one image forming device is indirectly communicable with the remote management server via another image forming device and indicating the another image forming device in case that the one image forming device is indirectly communicable with the remote management server via the another image forming device.

9. The remote setting method of claim 8, wherein in the transmitting, when the registering unit registers the information indicating that the first image forming device is neither directly nor indirectly communicable with the remote management server, the remote management server selects an image forming device which is directly communicable with the remote management server as the second image forming device from contents registered to the registering unit, and transmits the setting information to the second image forming device, and in the relaying, the second image forming device replies a communication result to the remote management server, the communication result indicating whether the second image forming device has transmitted the setting information to the first image forming device.

10. The remote setting method of claim 9, wherein the registering unit registers installation place information indicating an installation place of each image forming device, and in the transmitting, when the registering unit registers the information indicating that the first image forming device is neither directly nor indirectly communicable with the remote management server, the remote management server selects an image forming device which is installed near the first image forming device and is directly communicable with the remote management server, as the second image forming device from the contents registered to the registering unit.

11. An image forming device, comprising:

a first communication unit to communicate with another image forming device by using a first communication system;

a second communication unit to communicate with a remote management server by using a second communication system; and a control unit, wherein when the image forming device receives setting information for the another image forming device from the remote management server by using the second communication unit, the control unit transmits the received setting information to the another image forming device by using the first communication unit.

12. The image forming device of claim 11, wherein the setting information includes a connection setup for setting up a communication in which the another image forming device communicates with the remote management server not via a third image forming device.

13. The image forming device of claim 11, wherein the control unit transmits a communication result to the remote management server by using the second communication unit, the communication result indicating whether the image forming device has transmitted the setting information to the another image forming device by using the first communication unit.

* * * * *